United States Patent [19]

Graham

[11] 4,402,736

[45] Sep. 6, 1983

[54] COLD BONDING MINERAL PELLETIZATION

[75] Inventor: Roderick K. Graham, Oyster Bay, Australia

[73] Assignee: N. B. Love Industries Pty. Limited, New South Wales, Australia

[21] Appl. No.: 285,082

[22] PCT Filed: Nov. 17, 1980

[86] PCT No.: PCT/AU80/00089

§ 371 Date: Jul. 15, 1981

§ 102(e) Date: Jul. 15, 1981

[87] PCT Pub. No.: WO81/01421

PCT Pub. Date: May 28, 1981

[30] Foreign Application Priority Data

Nov. 23, 1979 [AU] Australia ..... PE1456

[51] Int. Cl.[3] ..... C22B 7/244

[52] U.S. Cl. ..... 75/0.5 R; 75/3; 264/117

[58] Field of Search ..... 75/0.5 R, 3–5; 264/117

[56] References Cited

U.S. PATENT DOCUMENTS

| | | | |
|---|---|---|---|
| 2,792,298 | 5/1957 | Freeman | 75/3 |
| 2,833,642 | 5/1958 | Barker et al. | 75/3 |
| 2,914,394 | 11/1959 | Dohmen | 75/3 |
| 2,914,395 | 11/1959 | Davies | 75/3 |
| 3,154,403 | 10/1964 | Stickley et al. | 75/3 |
| 3,493,642 | 2/1920 | Capes | 264/117 |

FOREIGN PATENT DOCUMENTS

| | | | |
|---|---|---|---|
| 223320 | 10/1957 | Australia | 75/3 |
| 448103 | 3/1972 | Australia | 75/3 |
| 503100 | 5/1954 | Canada | 75/3 |
| 1434406 | 5/1976 | United Kingdom | 75/44 |

*Primary Examiner*—Michael L. Lewis

*Attorney, Agent, or Firm*—Weingarten, Schurgin, Gagnebin & Hayes

[57] ABSTRACT

A method for agglomerating mineral fines for example iron ore fines, as described. The method comprises the steps of pelletizing a mixture comprising mineral fines and raw starch, treating the pellets so as substantially to gelatinize the starch and then drying the pellets or allowing them to dry. The process, which may be conducted without necessity to fire the pellets, yields adequate cold compressive strength at relatively low cost.

10 Claims, No Drawings

COLD BONDING MINERAL PELLETIZATION

TECHNICAL FIELD

This invention relates to a cold bonding process for pelletizing particles and more particularly for pelletizing ore fines.

The invention will herein be described with particular reference to its use in pelletizing iron ores, but it will be understood not to be limited to use in agglomerating that material.

BACKGROUND ART

Since the 1950's, pelletizing has been widely practised as a method of agglomerating iron ore fines as an aid to materials handling and transport. The first large plant in the United States with a capacity in excess of 6 million tons per annum commenced operation in 1955 and by 1975 iron ore pellet production in the United States was almost 60 million tons per annum. Pelletizing plants are now operated in many countries including Australia to facilitate intra and international transport of iron ores and their use in steel making.

The most widely used process is know as the "Fired Pellet", "Indurated" or "Hot Bonding" process and consists of two distinct operations; forming pellets at atmospheric temperature and then firing them at high temperature which is meant a temperature in the region of 2350° F. (1300° C.). In the first operation the pellets are first formed by rolling moist fine ore in either a horizontal drum, or more usually an inclined disk, to form spheres known as "green balls" or pellets. At this stage the pellets are required to have adequate strength to withstand handling to the firing stage and sometimes a minimum quantity of an inorganic or an organic binder is added to assist in achieving such adequate strength. In the second operation the pellets are fired. Firing is normally carried out in shaft furnaces, rotary kilns or travelling grate furnaces using gas or oil as fuel. The resulting fired pellets are typically spheroidal, of approximately 14–15 mm diameter, and have a cold compression strength of approximately of 500 lbs. force per pellet. "Cold compression strength" as herein used in a term familiar to those skilled in the art and is a measure of the load required to be applied to cause crushing of a substantially spherical pellet of predetermined diameter placed between two plates of an Instron tester or the like. As such they may be repeatedly bulk handled for example in loading to railway cars, unloading of railway cars, at port facilities, at steel works and the like, and withstand the rigours of transportion in bulk.

By virtue of the scale of throughput required by the industry, the capital investment in equipment necessary for the firing stage of pelletizing is major, and the energy consumption is high. The fuel costs of operating a typical installation are said to total millions of dollars per annum.

Many attempts have been made to find alternative agglomeration processes and in particular processes which would avoid the necessity for firing. To date no such process has proved satisfactory. The general requirements for good quality agglomerates include sufficient strength for handling and for long distance transportation, the ability to withstand outside storage without substantial detrimental effects, and complete reducibility in iron and steel furnaces without premature degradation or excessive swelling.

Numerous so called cold bonding processes have been developed in which inorganic binders such as cement, lime, magnesia, clays, bentonites and the like, or organic binder materials such as tars, petroleum residues, waxes, flours, paper industry by-products and polymers have been employed. In general the resulting pellets have been either too expensive to produce and/or have been deficient in strength, impact resistance or abrasion resistance. None of the organic and few of the inorganic binder cold bonding processes have warranted commercial production usage and of the latter none has achieved widespread acceptance.

An objective of the present invention is therefore to provide a method for pelletizing mineral fines which avoids the necessity to fire the pellets at high temperature while producing pellets of sufficient strength to permit handling, transportation and use in the manner usual for fired pellets.

A further objective is to produce pellets which, while not fired, are commercially acceptable as substitutes for pellets produced by the Fired Pellet process. To be commercially acceptable the pellets should be cost competitive, desirably have satisfactory strength, for example a compressive strength of the order of 300 lbs. force per pellet or higher, and for preference should be capable of manufacture in existing green ball forming equipment, ideally without significant modification of the operating conditions thereof.

Those objectives are achieved in preferred embodiments of the present invention by addition of a raw starch to the ore fines, pelletizing the resulting mixture substantially in accordance with the normal procedure for forming green balls, and subsequently gelatinizing the starch in situ.

Hitherto raw starch has sometimes been added to ores prior to pelletizing as a binder. As previously indicated binders may be added during the first stage of the fired pellet process for insuring that the green pellets have sufficient strength and abrasion resistance to withstand handling to the firing stage. However the resulting green balls have had a compressive strength typically of 10 lbs. that is to say one twentieth that typical of fired pellets, and have no merchantable utility until fired at 1200° C. In some cases binders consisting of bentonite and/or clays have employed minor amounts (for example one quarter percent by weight of iron ore) of gelatinized starch. However the gelatinized starch was then present for the purpose of lubricating the binding composition and those binders were used prior to firing rather than as a substitute for firing. It has not previously been proposed to use gelatinized starch as a binder instead of firing or to gelatinize starch in situ.

SUMMARY OF THE INVENTION

According to one aspect the invention consists in a method for agglomerating mineral fines comprising the steps of:

(a) pelletizing a mixture comprising mineral fines and an effective amount of raw starch, (b) treating the pellets so as substantially to gelatinize the starch, and (c) drying the pellets or allowing the pellets to dry.

According to a second aspect the invention consists in a process according to the first aspect wherein the said step of treating comprises heating the pellets for a time and at a temperature and in the presence of moisture sufficient substantially to gelatinize said starch.

According to a third aspect the invention consists in a pellet comprising mineral fines and gelatinized starch.

DETAILED DESCRIPTION OF THE PREFERRED EMBODIMENTS

By way of example only embodiments of the invention will now be described.

To the iron ore already ground to give a particle size distribution profile suitable for pelletizing is added some raw starch. While any starch may be used for example a tapioca starch, corn starch or potato starch, wheat starch has been found to give generally stronger pellets. It has been found that as the chain length of the starch molecules is shortened, the cold compression strength of the pellets obtained decreases. The amount of starch required is a compromise between cost of the starch, strength of the final pellet and decreased ore value. In practice a concentration of from 0.5% to 10%, and more preferably from 3 to 7% is found to be a satisfactory compromise. The starch may for example be added to the ore prior to feeding the ore to a balling drum or balling disk or may be added via the balling spray water during pelletizing.

Pelletizing is carried out in the normal manner with water being added as appropriate to the ore during this operation. The amount of water is of no special importance to the invention, the amount used being that required for satisfactory pelletizing. In practice for iron ore the amount of water would be about 10% by weight of the ore, but with other minerals, for example diatomite, water amounting to over 100% of the weight of the ore may be required.

After pelletizing, the green balls are transferred to a suitable container and are heated in order to gelatinize the starch. The temperature and time required varies with the source of the starch, the size of the pellets, final strength desired, the amount of water in the pellets and the nature of the ore. In the case of iron ore, and using a wheat starch, pellets of merchantable size processed at a temperature of around 100° C. in an atmosphere of high humidity wili attain 90% of the maximum cold compression strength in about 10 minutes, maximum strength being attained in about 1 hour.

The pellets are then dried, for example by allowing them to dry in air at ambient temperature. Dried iron ore pellets of 14 mm diameter and having an average cold compression strength of about 400 lbs. force per pellet are produced when a wheat starch is used in the above method at a weight of about 4½% on the weight of the balling feed ore. If the dry pellets are allowed to equilibrate against atmospheric moisture, the cold compression strength will decreased to about ¾ at worst of the dry pellet cold compression strength. The original compression strength is recovered if the pellets are again dried.

In another embodiment of the invention gelatinized starch is balled with the ore and then dried. In this case the gelatinized starch can be added via the balling spray during pelletization. However gelatinized spray feeds tend to be rather viscous and difficult to handle and furthermore are surface active and tend to cause changes in the operation of the balling equipment. Introduction of the starch as raw starch and subsequent gelatinization in situ is preferred among other reasons, because the balling parameters remain unaltered and the pelletization machinery can be operated in substantially conventional manner, and because of the comparative difficulties of handling gelatinized starch.

The strength of the product of the process is sufficient to enable use of the products as a substitute for pellets produced by the Fired Pellet process for most, if not all, purposes. The process step of gelatinization may be carried out in equipment which is simple, of low capital cost and with low energy consumption in comparison with furnaces required for the Fired Pellet process and by virtue that firing in a kiln or furnace is rendered unnecessary, considerable reduction in the capital investment and operating cost is obtained in comparison with the Fired Pellet process. Moreover pellets prepared by the method of the invention have a low moisture content at atmosphere equilibrium in comparison for example with iron ore to which water has been added for international shipment to prevent dust pollution.

While gelatinization by means of heat is preferred, chemicals or enzymes may be added or the starch may be modified to promote gelatinization and in this case methods are for preference chosen which minimize chain shortening. The process may be applied in the agglomeration of a wide range of mineral ores and artificial mixtures of organic and inorganic powders, bag house dust and the like. The term "mineral" as used herein includes ores and various naturally occurring homogeneous or apparently homogeneous solids and extends to include minerals of organic origin such as diatomaceous earth as well as those of artificial origin, for example, smelting by-products.

By way of further example Table I illustrates the cold compression strength of pellets of various mineral fines prepared in a manner similar to that described for iron ore and according to the invention.

It will be appreciated that for many practical purposes the pellet need only be sufficiently strong to survive handling in an intended application. Absolute strength is a function of the size and composition of the pellet.

Thus in the case of Diatomite fines the pellet compression strength is limited by the strength of the diatomite ore. If greater strength is required fibrous reinforcing materials may be added as well as the binder.

Pelletized innoculants, hot toppings and steel additives are subjected to limited handling and the requirement for compression strength is not as severe as in the case of iron ore fines.

It will be understood that the examples described herein are in no way limiting and that the order of the steps and the relative concentrations and conditions may be altered to an extent which will be apparent to those skilled in the art without departing from the inventive concept described.

INDUSTRIAL APPLICABILITY

The invention is applicable to the manufacture of (1) pellets for handling of a wide range of ores (2) pellets containing smelting additives (3) pellets containing alloy additives and the like (4) pellets for use in hot toppings (5) pellets for handling mineral waste fines and is also of use in other industrial applications.

TABLE 1

| Mineral | % wt by Pellet weight of Starch | Pellet Diameter | Cold Compression Strength (lbs) force per pellet |
|---|---|---|---|
| Diatomite fines (dust collector fines & sieve throughs) | 10% | 7.5 mm | 20 |
| Diatomite fines (dust collector fines & sieve throughs) | 5% | 7.55 mm | 30 |
| Clay fines | 5% | 6 mm | 16 |
| " | 5% | 9 mm | 30 |
| Hot topping mix | 5% | 6 mm | 30 |
| Iron Smelting Inoculants | 5% | 12 mm | 65 |
| Carbon-Ferro-chrome fines for use in steel making | 5% | 7 mm | 100 |
| Ferrosilicon fines for steel making | 5% | 6 mm | 21 |
| Iron Ore fines (balling grade) | 5% | 13 mm | 321 |
| | 5% | 15 mm | 447 |
| | 5% | 17 mm | 540 |

What is claimed is:

1. A method for agglomerating mineral fines comprising the steps of:

(a) pelletizing a mixture consisting of mineral fines and an effective amount of raw starch, (b) subsequently treating the pellets to substantially gelatinize the starch, and (c) drying the pellets gelatinization at a temperature substantially below firing temperature.

2. A method according to claim 1 wherein the raw starch is added to the mineral fines prior to said step of pelletising.

3. A method according to claim 1 or claim 2 wherein said step of treating comprises heating the pellets for a time and at a temperature and in the presence of moisture sufficient substantially to gelatinize said starch.

4. A method according to claim 3 wherein said step of treating is conducted at a temperature in the range of 70° C. to 170° C. and in an atmosphere of high humidity.

5. A method according to claim 3 wherein said step of treating is conducted in an atmosphere of high humidity and at a temperature in the range of from 75° C. to 100° C.

6. A method according to claim 1 wherein the starch is a wheat starch.

7. A method according to claim 1 wherein said starch comprises from 0.5% to 10% by weight of the pellet.

8. A method according to claim 1 wherein said starch comprises from 3% to 7% by weight of the pellet.

9. A method according to claim 1, wherein said mineral fines are iron ore fines.

10. A pellet manufactured by the method of claims 1, 7, or 9 having, when dry, a cold compression strength in excess of 300 lbs.

* * * * *